US005503355A

United States Patent [19]

Tan

[11] Patent Number: 5,503,355

[45] Date of Patent: Apr. 2, 1996

[54] BAG SUPPORT

[76] Inventor: Peter Y. Tan, 38 Harwood Dr., St. Albert, Canada, T8N 5P8

[21] Appl. No.: 332,764

[22] Filed: Nov. 1, 1994

[51] Int. Cl.[6] ..... B65B 67/04

[52] U.S. Cl. ..... 248/101

[58] Field of Search ..... 248/95, 97, 99, 248/100, 101, 98, 150, 165, 166; 220/404; 141/314, 391

[56] References Cited

U.S. PATENT DOCUMENTS

| | | | |
|---|---|---|---|
| 4,705,247 | 11/1987 | Delmerico | 248/98 |
| 4,830,317 | 5/1989 | Kober et al. | 248/97 |
| 5,252,925 | 10/1993 | Hayley, Sr. | 248/98 X |

FOREIGN PATENT DOCUMENTS 2672566 8/1992 France .

*Primary Examiner*—Ramon O. Ramirez
*Attorney, Agent, or Firm*—Anthony R. Lambert

[57] ABSTRACT

A bag support is described which includes a two part support frame with a first portion and a second portion. The first portion has a first end and a second end. The second portion has a first end and a second end. The second end of the second portion is pivotally mounted to the second end of the first portion. The first portion and the second portion are relatively movable between an open position and a closed position. In the open position the first end of the first portion is spaced from the first end of the second portion. In the closed position the first end of the first portion is immediately adjacent the first end of the second portion. A first bag holding clamp is provided at the first end of the first portion, whereby the first bag holding clamp grips one side of an access opening to a bag. A second bag holding clamp is are provided at the first end of the second portion whereby the second bag holding clamp grips another side of the access opening of the bag. When the support frame is in the open position the access opening to the bag is held open and when the support frame is in the closed position the access opening to the bag is held closed. A locking engagement maintains the first portion and the second portion in the closed position.

4 Claims, 4 Drawing Sheets

BAG SUPPORT

BACKGROUND OF THE INVENTION

There are numerous configurations for a bag support. Although the bags supported can be used for an infinite variety of purposes, the more common use is to hold refuse. When refuse is to be contained in the bag which is supported, it is preferable that a lid or other form of closure be provided to confine odours. There are some bag supports that are quite ornate and can be considered to be aesthetically appealing. The majority of bag supports, however, are not aesthetically appealing and are intended to be placed in cupboards or other confined spaces to keep them out of sight. Unfortunately, when a bag support is equipped with a lid or similar form of closure it requires more room and is, therefore, not as suitable for positioning in a confined space.

SUMMARY OF THE INVENTION

What is required is an alternative form of bag support that is better suited for positioning within a confined space while remaining suited for holding refuse.

According to the present invention there is provided a bag support which includes a two part support frame with a first portion and a second portion. The first portion has a first end and a second end. The second portion has a first end and a second end. The second end of the second portion is pivotally mounted to the second end of the first portion. The first portion and the second portion are relatively movable between an open position and a closed position. In the open position the first end of the first portion is spaced from the first end of the second portion. In the closed position the first end of the first portion is immediately adjacent the first end of the second portion. First bag holding means are provided at the first end of the first portion, whereby the first bag holding means grips one side of an access opening to a bag. Second bag holding means are provided at the first end of the second portion whereby the second bag holding means grips another side of the access opening of the bag. When the support frame is in the open position the access opening to the bag is held open and when the support frame is in the closed position the access opening to the bag is held closed. Locking means are provided to maintain the first portion and the second portion in the closed position.

The bag support, as described above, can be placed in the open position to receive refuse, and then pivoted into the closed position. In the closed position, the bag support frame takes comparatively little space and at the same time due to the relative positioning of the first portion and the second portion of the support frame will serve to confine unpleasant odours.

Although beneficial results may be obtained through the use of the bag support, as described above, the weight of a full bag being supported can place a strain upon the pivotal connection between the first portion and the second portion of the support frame. Even more beneficial results may, therefore, be obtained when one of the first portion and the second portion of the support frame has a pair of substantially perpendicularly projecting braces with generally arcuate guide surfaces. An other of the first portion and the second portion has opposed edges that extend between the first end and the second end with the opposed edges having followers that slide along the guide surfaces. With the structure, as described above, the braces bear a large portion of the weight thereby relieving strain upon the pivotal connection.

With the bag support, as described above, having a bag attached to the first bag holding means and the second bag holding means will serve to limit relative outward pivotal movement of the first portion and the second portion of the support frame in the open position. There is a danger, however, that the tensile strength of the bag may not withstand such strain as the bag becomes full. Even more beneficial results may, therefore, be obtained when the arcuate guide surfaces terminate in projecting shoulders which serves as the stop means to limit relative outward pivotal movement of the first portion and the second portion in the open position.

Although beneficial results may be obtained through the use of the bag support, as described above, in order to keep cost to a minimum a simple and inexpensive means must be found to lock the first portion and the second portion in the closed position. Even more beneficial results may, therefore, be obtained when the first portion of the support frame has the substantially perpendicularly extending braces. The opposed edges of the second portion have outwardly projecting pins. The projecting pins are received in elongate slots in the brace. The arcuate guide surfaces have notches sized to receive the followers. In the closed position the pins slide in the elongate slots allowing the followers to be received in the notches. This engagement between the followers and the notches serves as locking means to lock the first portion and the second portion of the support frame in the closed position.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
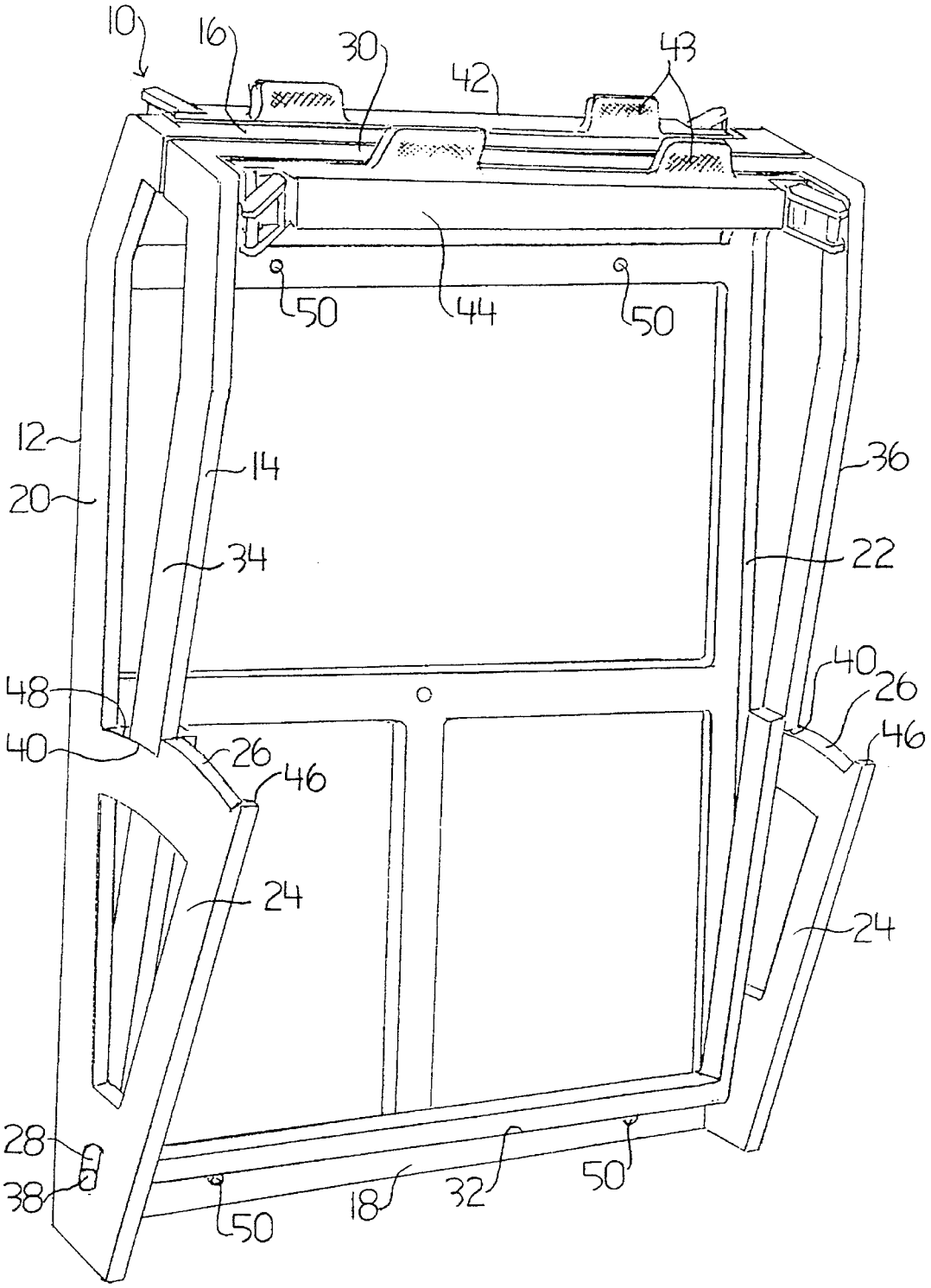
FIG. 1 is a perspective view of a bag support constructed in accordance with the teaching of the present invention, in a closed position.

The preferred embodiment, a bag support generally identified by reference numeral 10, will now be described with reference to FIGS. 1 through 5.

Figure 2:
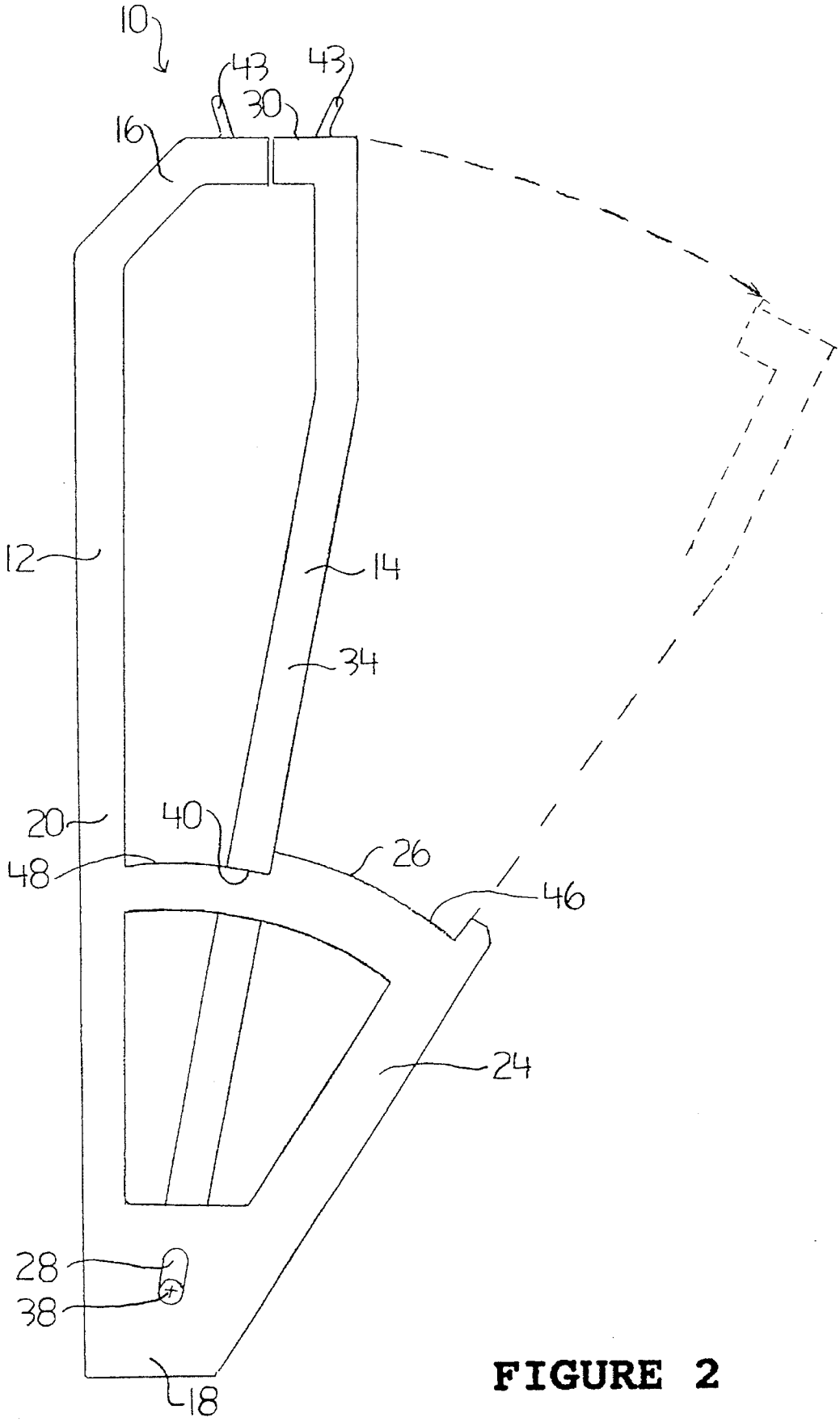
FIG. 2 is a side elevation view of the bag support illustrated in FIG. 1.
Figure 3:
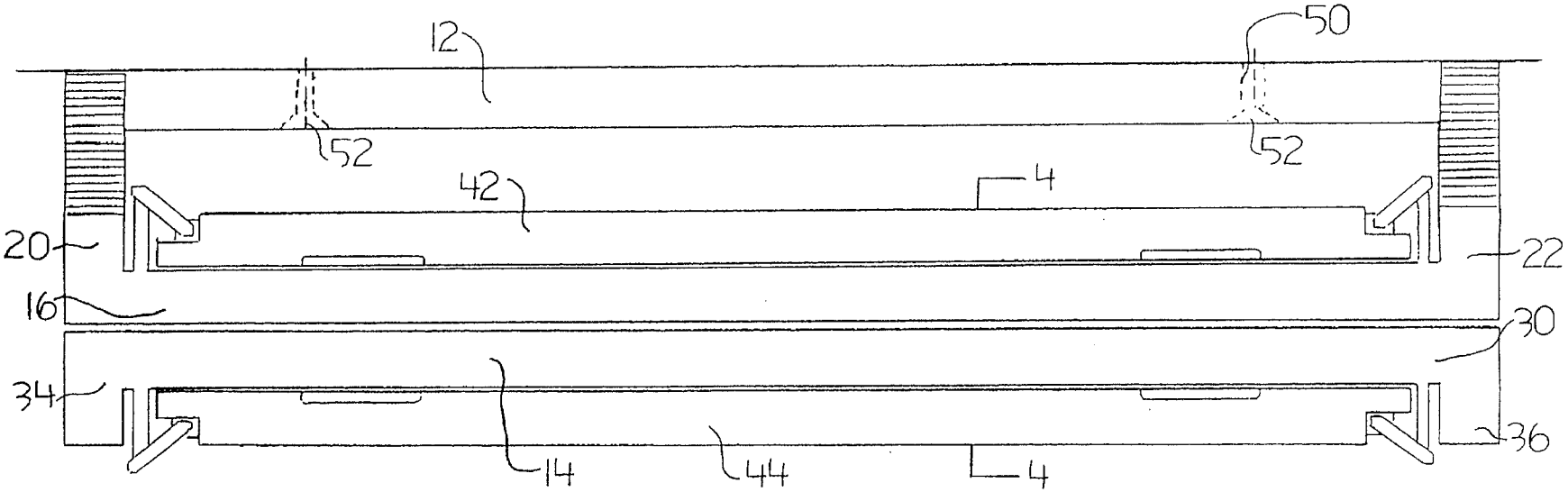
FIG. 3 is a top plan view of the bag support illustrated in FIG. 1.
Figure 4:
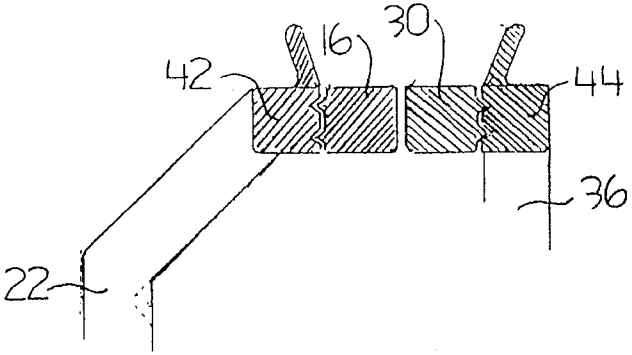
FIG. 4 is a section view taken along section lines 4—4 of FIG. 3.
Figure 5:
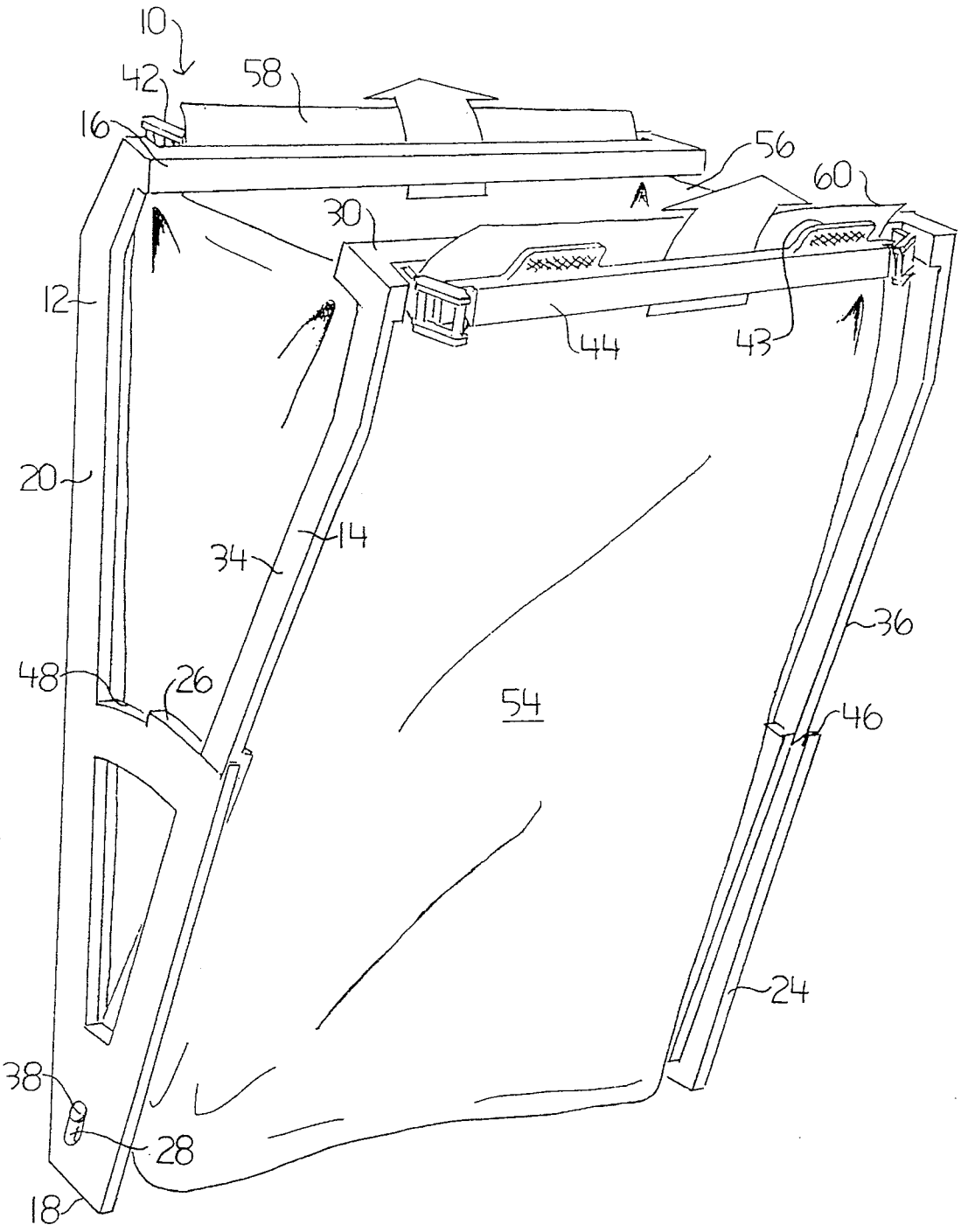
FIG. 5 is a perspective view of the bag support illustrated in FIG. 1, with a bag being supported in an open position.

Referring to FIG. 1, bag support 10 includes a two part support frame including a first portion 12 and a second portion 14. First portion 12 has a first end 16, a second end 18 and opposed edges 20 and 22. A pair of spaced apart substantially perpendicularly projecting braces 24 project from first portion 10. Each of braces 24 have a generally arcuate guide surface 26 and elongate slots 28. Second portion 14 has a first end 30, a second end 32, and opposed edges 34 and 36 that extend between first end 30 and second end 32. Edges 34 and 36 have outwardly projecting pins 38. Edges 34 and 36 both have a jog that forms an outwardly projecting followers 40. Followers 40 slide along guide surfaces 26 of first portion 12. Second end 32 of second portion 14 is pivotally mounted to second end 18 of first portion 12 by means of outwardly projecting pins 38 that are received in elongate slots 28 in brace 24. First portion 12 and second portion 14 are relatively movable between an open position, illustrated in FIG. 5, and a closed position, illustrated in FIGS. 1 and 2. Referring to FIG. 5, in the open position first end 16 of first portion 12 is spaced from first end 30 of second portion 14. Referring to FIG. 2, in the closed position first end 16 of first portion 12 is immediately adjacent first end 30 of second portion 14. Referring to FIGS. 3 and 4, a first bag holding clamp 42 is positioned at first end 16 of first portion 12. A second bag holding clamp 44 is positioned at first end 30 of second portion 14. Referring to FIG. 2, arcuate guide surfaces 26 terminate in a projecting shoulder 46. Projecting shoulder 46 serves to limit relative outward pivotal movement of first portion 12 and second portion 14 in the open position, as illustrated in FIG. 5. Referring to FIG. 2, arcuate guide surfaces 26 have a notch 48 adjacent first portion 12. Notches 48 are sized to receive followers 40. In the closed position projecting pins 38 slide in elongate slots 28, allowing followers 40 to drop into notches 48. This locks first portion 12 and second portion 14 in the closed position. First portion 12 has mounting apertures 50. It is preferred that bag holding clamps 42 and 44 have tabs 43.

The use and operation of bag support 10 will now be described with reference to FIGS. 1 through 5. Although bag support 10 can be made with a self supporting base, it is preferred that bag support 10 be mounted to a vertical surface, such as a cupboard wall. Referring to FIG. 3, this is accomplished by extending screws 52 through mounting apertures 50 to securely fasten first portion 12 to the cupboard wall. Referring to FIG. 5, a bag 54 is fastened in bag support 10. Bag 54 has an access opening 56. First bag holding clamp 42 grips one side 58 of access opening 56 to bag 54. Second bag holding clamp 44 grips another side 60 of access opening 56 of bag 54. Side 58 of access opening 56 of bag 54 moves with first portion 12. Side 60 of access opening 56 of bag 54 moves with second portion 14. When bag support 10 is in the open position, as illustrated in FIG. 5, access opening 56 to bag 54 is held open to receive refuse. When bag support 10 is in the closed position, as illustrated in FIGS. 1 and 2, access opening 56 to bag 54 is held closed. Referring to FIG. 2, bag support 10 can be moved from the closed position to the open position by lifting upwardly on second portion 14 and pivoting second portion 14 outwardly relative to first portion 12. Raising second portion 14 allows followers 40 to clear notches 48. Once clear of notches 48, follows 40 slide along guide surfaces 26 until they reach projecting shoulder 46 that serves as a stop to limit relative outward pivotal movement of first portion 12 and second portion 14 in the open position. The manner in which the raising of second portion 14 is accommodated at the pivotal connection should be noted. Projecting pins 38 slide along elongate slots 28. In the open position illustrated in FIG. 5, projecting pins 38 are toward the top portion of elongate slots 28. In the closed position illustrated in FIGS. 1 and 2, projecting pins 38 are toward the bottom of elongate slots 28. To return bag support 10 to the closed position, second portion 14 is pushed toward first portion 12. Followers 40 will slide along guides surfaces 26 until notches 48 are reached. Once notches 48 are reached, followers 40 drop into notches 48 to lock first portion 12 and second portion 14 in the closed position. Referring to FIG. 2, it is preferred that first ends 16 and 30 are bent inwardly. This enables first ends 16 and 30 to meet before first portion and second portion reach a parallel position. When bag 54 is full of refuse this is useful in ensuring that the expanded bulk of bag 54 does not interfere with bag support 10 being placed in the closed position. When bag 54 becomes full, holding tabs 43 can be used to release the clamping force of bag holding clamps 42 and 44.

It will be apparent to one skilled in the art that modifications may be made to the illustrated embodiment without departing from the spirit and scope of the invention as defined by the claims.

The Embodiments of the Invention in which an Exclusive Property or Privilege is claimed are as follows:

1. A bag support, comprising:

a two part support frame including a first portion and a second portion, the first portion having a first end and a second end; the second portion having a first end and a second end, the second end of the second portion being pivotally mounted to the second end of the first portion defining a pivot axis, the first portion and the second portion being relatively movable between an open position and a closed position, in the open position the first end of the first portion is spaced from the first end of the second portion assuming a "V" shaped configuration, in the closed position the first end of the first portion is immediately adjacent the first end of the second portion;

first bag holding means at the first end of the first portion, whereby the first bag holding means holds one side of an access opening to a bag;

second bag holding means at the first end of the second portion whereby the second bag holding means holds another side of the access opening of the bag such that when the support frame is in the open position the access opening to the bag is held open and when the support frame is in the closed position the access opening to the bag is held closed;

one of the first portion and the second portion of the support frame having a pair of substantially perpendicularly projecting braces with generally arcuate guide surfaces spaced from and centered about the pivot axis, and an other of the first portion and the second portion having opposed edges with projecting followers that slide along the guide surfaces upon radial movement of the other of the first portion and the second portion in relation to the pivot axis, the followers being in continuous sliding contact with the guide surfaces; and locking means to maintain the first portion and the second portion in the closed position.

2. The bag support as defined in claim 1, wherein the arcuate guide surfaces terminate in a projecting shoulder which serves as the stop means to limit relative outward pivotal movement of the first portion and the second portion in the open position.

3. A bag support, comprising:

a two part support frame including a first portion and a second portion, the first portion having a first end and a second end; the second portion having a first end and a second end, the second end of the second portion being pivotally mounted to the second end of the first portion, the first portion and the second portion being relatively movable between an open position and a closed position, in the open position the first end of the first portion is spaced from the first end of the second portion, in the closed position the first end of the first portion is immediately adjacent the first end of the second portion;

first bag holding means at the first end of the first portion, whereby the first bag holding means holds one side of an access opening to a bag;

second bag holding means at the first end of the second portion whereby the second bag holding means holds another side of the access opening of the bag such that when the support frame is in the open position the access opening to the bag is held open and when the support frame is in the closed position the access opening to the bag is held closed;

the first portion of the support frame having a pair of substantially perpendicularly projecting braces with generally arcuate guide surfaces, and the second portion having opposed edges with projecting followers that slide along the guide surfaces; and locking means to maintain the first portion and the second portion in the closed position, the locking means including the pivotal connection between the first portion and the second portion of the support frame including opposed edges with projecting pins on the second portion that are received in elongate slots in the brace, the arcuate guide surfaces having notches sized to receive the followers such that in the closed position the pins slide in the elongate slots allowing the followers to be received in the notches, thereby locking the first portion and the second portion of the support frame in the closed position.

4. A bag support, comprising:

a two part support frame including a first portion and a second portion;

the first portion having a first end, a second end and a pair of spaced apart substantially perpendicularly projecting braces each having a generally arcuate guide surface and elongate slots;

the second portion having a first end, a second end, opposed edges that extend between the first end and the second end, the edges having outwardly projecting pins and an outwardly projecting follower, the follower of the second portion sliding along the guide surface of the first portion, the second end of the second portion being pivotally mounted to the second end of the first portion by the outwardly projecting pins that are received in the elongate slots in the brace, the first portion and the second portion being relatively movable between an open position and a closed position, in the open position the first end of the first portion is spaced from the first end of the second portion, in the closed position the first end of the first portion is immediately adjacent the first end of the second portion;

a first bag holding clamp at the first end of the first portion, whereby the first bag holding clamp grips one side of an access opening to a bag;

a second bag holding clamp at the first end of the second portion whereby the second bag holding clamp grips another side of the access opening of the bag such that when the support frame is in the open position the access opening to the bag is held open and when the support frame is in the closed position the access opening to the bag is held closed;

the arcuate guide surface terminates in a projecting shoulder which serves to limit relative outward pivotal movement of the first portion and the second portion in the open position; and the arcuate guide surface has a notch adjacent the first portion, the notch being sized to receive the follower such that in the closed position the pin slides in the elongate slot allowing the follower to be received in the notch and thereby locking the first portion and the second portion of the support frame in the closed position.

* * * * *